US007068237B2

(12) United States Patent
Fukuda

(10) Patent No.: US 7,068,237 B2
(45) Date of Patent: Jun. 27, 2006

(54) ANTENNA DEVICE AND WIRELESS COMMUNICATION DEVICE USING SAME

(75) Inventor: Junichi Fukuda, Tokyo (JP)

(73) Assignee: NEC Corporation (JP)

( * ) Notice: Subject to any disclaimer, the term of this patent is extended or adjusted under 35 U.S.C. 154(b) by 0 days.

(21) Appl. No.: 10/903,186

(22) Filed: Jul. 30, 2004

(65) Prior Publication Data

US 2005/0024286 A1 Feb. 3, 2005

(30) Foreign Application Priority Data

Jul. 30, 2003 (JP) ..... 2003-282231

(51) Int. Cl.
*H01Q 21/12* (2006.01)

(52) U.S. Cl. ..... 343/815; 343/816; 343/793; 343/795

(58) Field of Classification Search ..... 343/815, 343/816, 770, 753
See application file for complete search history.

(56) References Cited

U.S. PATENT DOCUMENTS 3,925,784 A 12/1975 Phelan ..... 343/754
4,811,032 A 3/1989 Boksberger et al. ..... 343/876
5,134,418 A * 7/1992 Gomez et al. ..... 343/718
5,294,939 A * 3/1994 Sanford et al. ..... 343/836
6,175,723 B1 * 1/2001 Rothwell, III ..... 455/63.1
6,198,438 B1 * 3/2001 Herd et al. ..... 343/700 MS
6,417,807 B1 * 7/2002 Hsu et al. ..... 343/700 MS

OTHER PUBLICATIONS

IEEE International; Symposium, Antennas and Propagation Society, vol. 3, Jul. 8-13, 2001, pp. 654-657 "MEMS-Switched Reconfigurable Antenna" (William H. Weedon, et al.

* cited by examiner

*Primary Examiner*—Trinh Vo Dinh
(74) *Attorney, Agent, or Firm*—Ostrolenk, Faber, Gerb & Soffen, LLP

(57) ABSTRACT

An antenna device is provided which is capable of dealing with two or more frequencies or of carrying out communications using two or more communication methods by a single antenna and of controlling its directivity and, therefore, of achieving improvements in communication performance of the antenna device. The antenna device is so constructed that its shape is freely changed and its directivity can be changed to deal with a signal in any frequency band. The antenna device is made up of two or more antenna elements and switches which put each of the antenna elements into a connected or disconnected state. By controlling the switches, a shape of the antenna is changed so as to have a 90-degree bent dipole configuration to provide directivity, and a length of the antenna is changed so as to allow a changeover of a frequency band. The antenna device has a reflector being similar to the dipole-type antenna, which enables improvements in its directivity.

9 Claims, 7 Drawing Sheets

ANTENNA DEVICE AND WIRELESS COMMUNICATION DEVICE USING SAME

BACKGROUND OF THE INVENTION

1. Field of the Invention

The present invention relates to an antenna device and a wireless communication device using the antenna device and more particularly to improvements of the antenna device that can be used suitably for a portable wireless terminal.

The present application claims priority of Japanese Patent Application No. 2003-282231 filed on Jul. 30, 2003, which is hereby incorporated by reference.

2. Description of the Related Art

Many of antennas used in a wireless communication device, especially in a portable wireless terminal such as a portable cellular phone, portable information terminal, or a like in mobile communications are of a non-directivity type. The reasons are that a direction of a base station with which a portable wireless terminal communicates varies and becomes inconstant depending on a position of the portable wireless terminal or on its movement.

Conventionally, such antennas as a monopole antenna, helical antenna, inverted F-type embedded antenna, or the like is often used in a portable cellular phone as a non-directivity-type antenna.

However, improvements in performance of an antenna become necessary as demands for a speedup in data communications or for an increase in a communication distance increase. A possible method for improving the performance of an antenna is to achieve high gain by getting an antenna to have directivity. By using this method, since an effect of lowering gain in an unwanted direction of signals is also expected, improvements not only in signal receiving sensitivity but also in an SIR (Signal to Interference Ratio) are made possible.

There is also a growing demand that a portable wireless terminal deal with signals having two or more communication frequencies or signals to be received or transmitted by two or more communication methods. To meet this demand, it is necessary that a portable wireless terminal be equipped with two or more antennas capable of dealing with signals having two or more communication frequencies or signals to be communicated by two or more communication methods or with an antenna capable of dealing with signals having two or more frequencies.

Moreover, when a high-speed communication is carried out, a range of frequencies to be used has to be wide and, when two or more communication methods are used, a frequency to be used has to be changed in some cases and, therefore, a wideband antenna that can cover all ranges of frequencies is required.

In a wireless communication device, in order to control directivity in a portable wireless terminal in particular, an antenna made up of two or more antenna elements such as an array antenna is conventionally used. However, to achieve this aim, some distance between the antenna elements is needed, which, as a result, causes the antenna itself to be made larger. Also, to control antenna directivity, signal control is required in each of the two or more antenna elements, which causes communication processing to be made complicated and, at the same time, causes an increase in power consumption. Furthermore, if two or more antennas are used to carry out communications employing two or more communication frequencies and/or employing two or more communication methods, problems related to mounting of antennas such as difficulties caused by a difference in size among the antennas and/or interference among the antennas may occur.

Moreover, switches are needed to switch each of the two or more antennas and, therefore, power loss caused by the switch produces a problem, which also causes an antenna to increase in size. The antennas that can deal with signals having two or more frequencies present another problem in that frequencies to be used are limited and actually there are cases in which they have elements that resonate at each frequency.

A shape-variable antenna is disclosed in a non-patent document, IEEE International Symposium, Antennas and Propagation Society, Vol. 3, 8–13, July, 2001, pp. 654–657, "MEMS (Micro Electro Mechanical System)-Switched Reconfigurable Antenna" (William H. Weedon, et al.) in which, in order to deal with signals having two or more frequencies, four antenna elements are arranged in a 2×2 matrix form and switches are mounted so that they switch the antenna elements between electrically connected and disconnected states and so that they control change in shape of the antenna elements so as to deal with signals in two frequency bands, that is, an L band (1 GHz to 2 GHz) and an X band (8 GHz to 12.5 GHz) and in which a wide-band MEMS switch that can deal with a signal in a frequency band of 0 to 40 MHz is employed.

However, such a conventional antenna as described in the above non-patent reference has a problem. That is, though the above antenna that can deal with signals in two frequency bands is achieved by using one device, no consideration is given to directivity and, therefore, antenna directivity cannot be controlled.

SUMMARY OF THE INVENTION

In view of the above, it is an object of the present invention to provide an antenna device (antenna structure) which is capable of dealing with two or more frequencies or of carrying out communications using two or more communication methods by a single antenna and of controlling antenna directivity to achieve improvements in communication performance of the antenna.

According to a first aspect of the present invention, there is provided an antenna device including:

two or more antenna elements; and switches to control so as to put the antenna elements being adjacent to each other into an electrically connected or disconnected state;

wherein antenna directivity is controlled by controlling the switches.

According to a second aspect of the present invention, there is provided an antenna device including two or more antenna elements, and switches to control so as to put the antenna elements being adjacent to each other into an electrically connected or disconnected state, Wherein a cross-dipole antenna having a 90-degree bent shape is formed by a group of the antenna elements being electrically connected to one another by the switches.

In the foregoing, a preferable mode is one wherein each of the switches has a variable reactance component.

A preferable mode is one wherein a signal line for inputting and outputting of signals is connected to at least one antenna element selected from a group of the antenna elements being electrically connected to one another by the switches.

Also, a preferable mode is one that wherein further includes an other group of the antenna elements being connected to one another by the switches and being located at a specified distance apart from the group of the antenna elements, wherein the group of the antenna elements to be connected to the signal line from which power is fed act as a radiation element, whereas the other group of antenna elements acts as a reflector or as a wave director.

Also, a preferable mode is one wherein the other groups of antenna elements also have a 90-degree bent shape.

Also, a preferable mode is one wherein each of the switches is made up of a high-frequency transistor, pin diode, or MEMS switch.

Also, a preferable mode is one wherein the antenna elements and the switches are formed on a dielectric.

Furthermore, a preferable mode is one that which includes a storing unit to store, in advance, two or more sets of combinations of electrically connected or disconnected states of the switches and a controlling unit to read a specified set of the combinations from the storing unit according to a control signal so that the switches are controlled.

According to a third aspect of the present invention, there is provided a wireless communication device being equipped with an antenna device including two or more antenna elements; and switches to control so as to put the antenna elements being adjacent to each other into an electrically connected or disconnected state, wherein antenna directivity is controlled by controlling the switches.

According to a fourth aspect of the present invention, there is provided a wireless communication device being equipped with an antenna device including two or more antenna elements, and switches to control so as to put the antenna elements being adjacent to each other into an electrically connected or disconnected state, wherein a cross-dipole antenna having a 90-degree bent shape is formed by a group of the antenna elements being electrically connected to one another by the switches.

With the above configuration, a shape of the antenna can be changed freely by arranging two or more switch elements in proximity to one another and by making connections among antenna elements being adjacent to each other to achieve ON-OFF connection of the antenna elements using these switch elements and, therefore, control on directivity of the antenna is made possible and changes of frequencies can be easily controlled.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings.

First Embodiment

Figure 1:
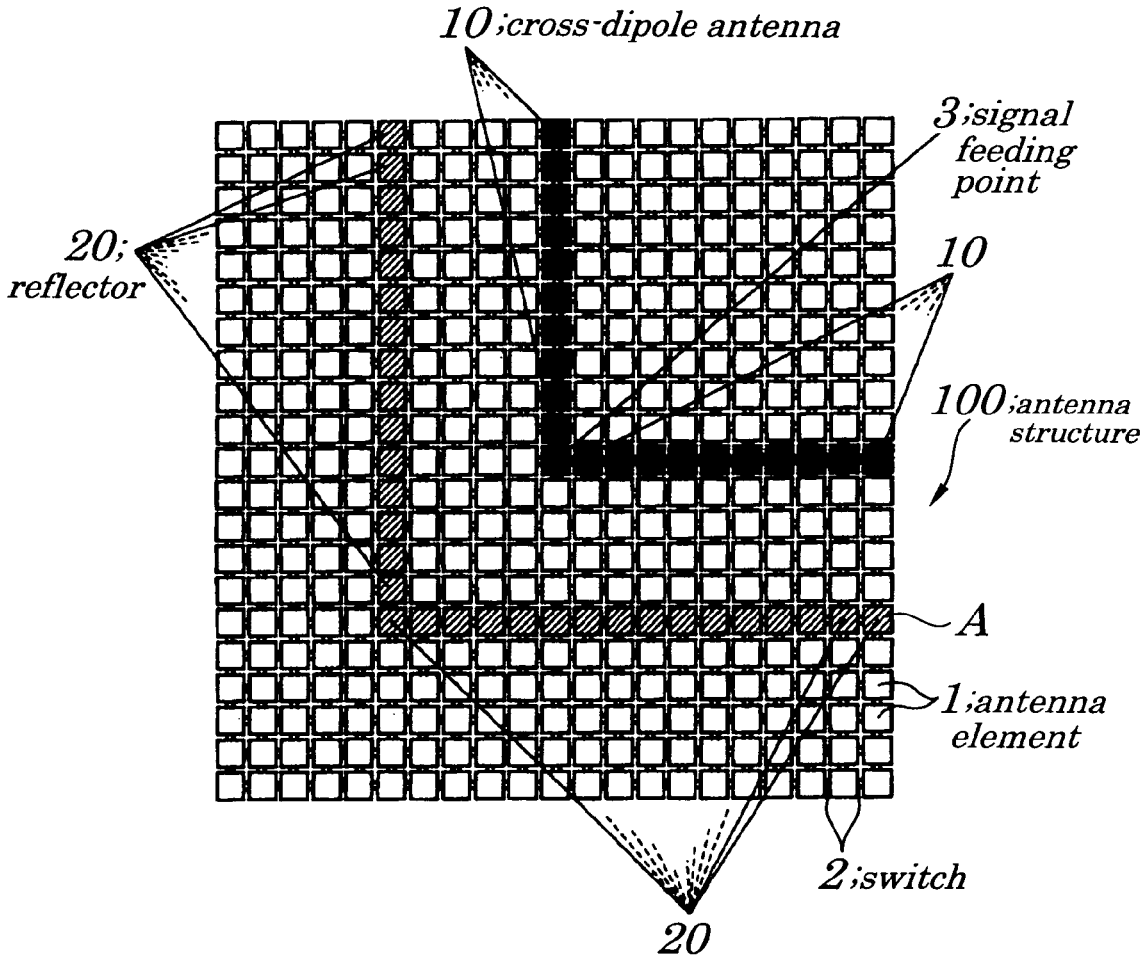
FIG. 1 is a plan view showing configurations of an antenna according to a first embodiment of the present invention.
Figure 2:
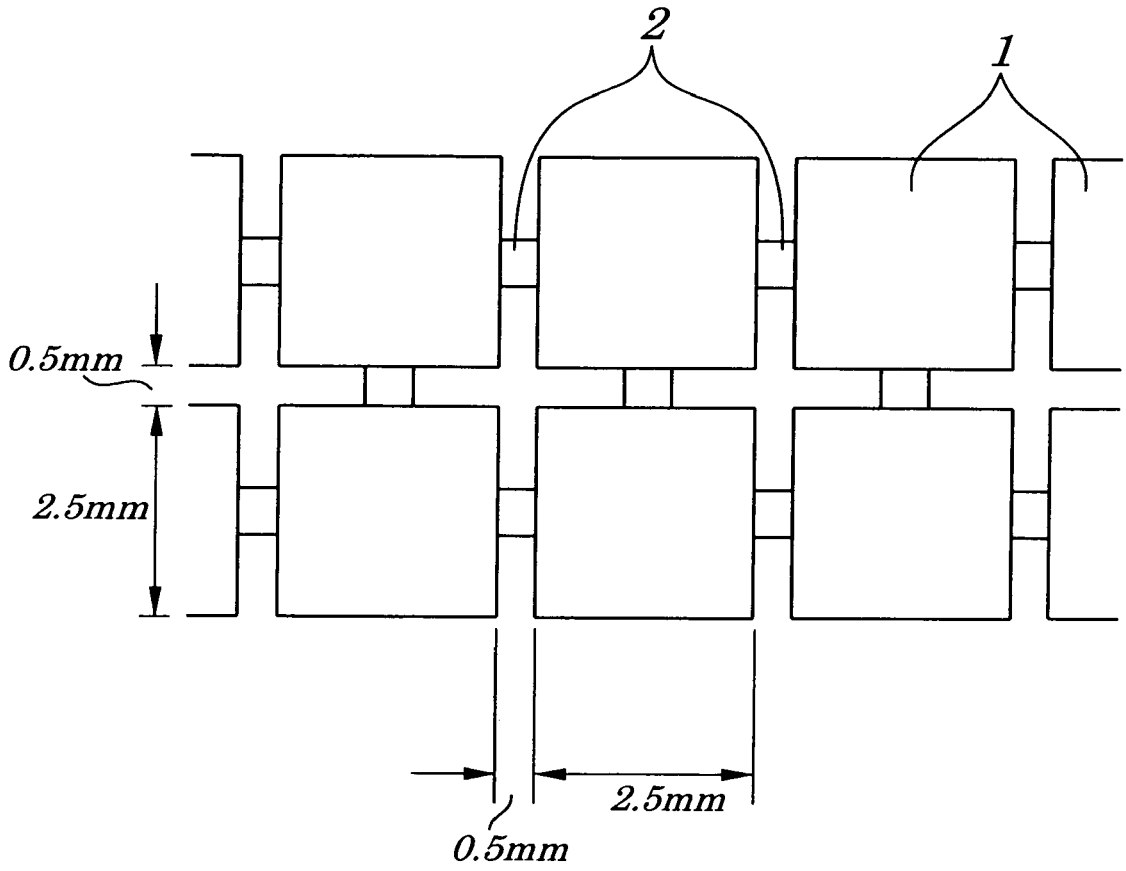
FIG. 2 is a partially expanded diagram of the antenna according to the first embodiment of the present invention.

FIG. 1 is a plan view showing configurations of an antenna structure (antenna device) 100 according to a first embodiment of the present invention. FIG. 2 is a partially expanded diagram of the antenna structure 100 according to the first embodiment of the present invention. As shown in FIGS. 1 and 2, twenty-one pieces of antenna elements 1 each forming a square whose side is 2.5 mm are arranged in a matrix form at intervals of 0.5 mm both in a horizontal direction and in a vertical direction. That is, the antenna structure 100 is made up of a matrix of twenty-one pieces of antenna elements 1 by twenty-one antenna elements 1. The antenna elements 1 being adjacent to each other are connected to one another by each of switches 2 and the antenna elements 1 being adjacent to each other are put into an electrically connected or disconnected state by controlling ON or OFF each of the switches 2.

A group of antenna elements 1, which is filled in with black in FIG. 1, acts as a radiator to which signal power is fed and also serves as a cross-dipole antenna 10. To feed signal power to the antenna elements 1, switches being mounted among antenna elements 1, which are filled in with black in FIG. 1, are in an ON state. Moreover, a size of the antenna element 1 whose switch is turned OFF is so small compared with a wavelength of a signal and, therefore, no radiation characteristic is affected. In the first embodiment, the cross-dipole antenna 10 acting as the radiator is so formed as not to be of a straight-line shape but to be of a 90-degree bent shape so that the antenna structure 100 has directivity. One antenna element positioned in a center of the group of antenna elements 1 serves as a signal feeding point 3 of the cross-dipole antenna 10.

Moreover, the antenna structure 100 is so constructed to have a reflector 20 being aimed to further improve its directivity. Connection states of the switch 2 are controlled so that the reflector 20 has a figure being similar to that of the cross-dipole antenna 10 serving as the radiator. That is, a group of antenna elements 1 (shown by hatching A in FIG. 1) making up the cross-dipole antenna (serving as the radiator) 10 and having a 90-degree bent shape, which is located at a specified distance apart from the group of the antenna elements 1 (which are filled in with black in FIG. 1), each being electrically connected by the switch 2 placed among antenna elements 1 being adjacent to each other.

Figure 3:
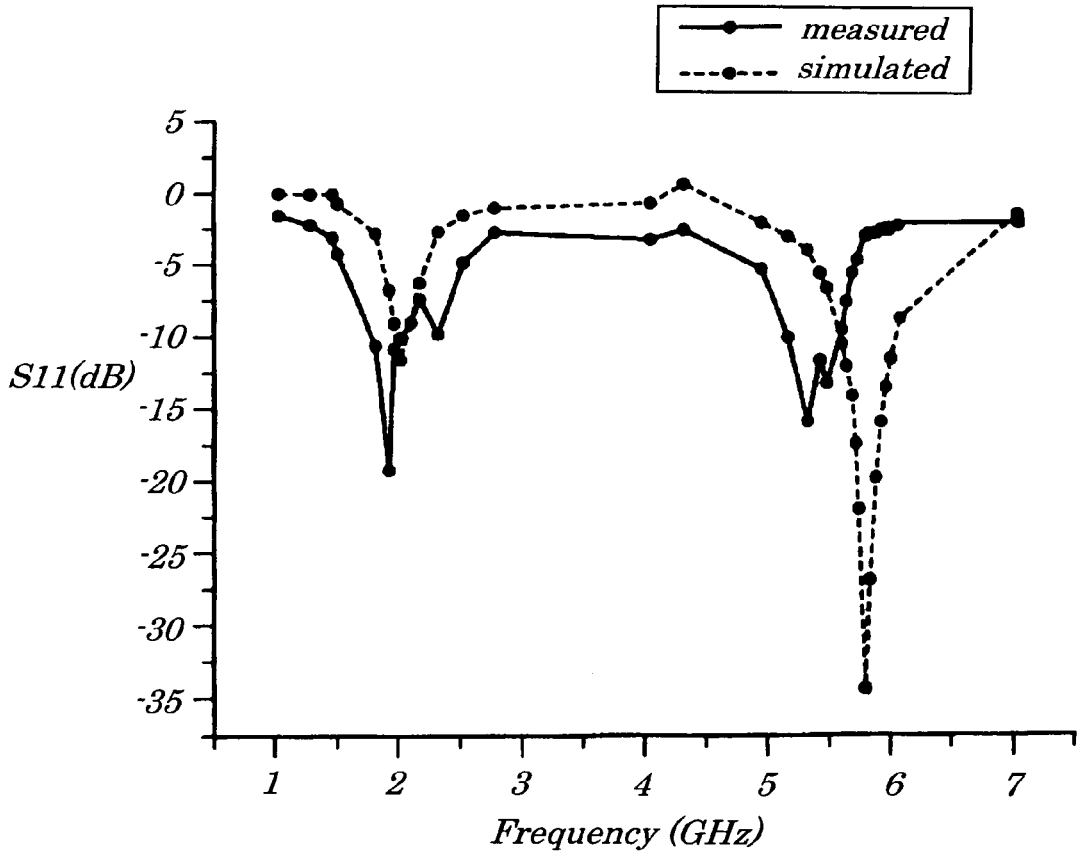
FIG. 3 is a diagram showing a reflection characteristic of the antenna of the first embodiment shown in FIG. 1.

FIG. 3 is a diagram showing a reflection characteristic of the antenna structure 100 shown in FIG. 1. The antenna structure 100 of the first embodiment provides a multi-band characteristic having two resonance points at frequencies of about 2 GHz and 6 GHz. This represents a characteristic of a dipole antenna which resonates at wavelengths of $\lambda/2$ and $3\lambda/2$, where $\lambda$ represents a signal wavelength. To get the antenna structure to resonate at another frequency, for example, between 2 GHz and 6 GHz, all that is needed is to reduce a length of an element of the dipole antenna. That is, such a resonance between 2 GHz and 6 GHz can be achieved by changing an ON/OFF state of the switch 2 and decreasing the number of antenna elements 1 to be connected so that an entire length of the cross-dipole antenna becomes smaller than that of the cross-dipole antenna 10 as shown in FIG. 1. In FIG. 3, actually-measured data is shown by solid lines and simulated-data is shown by dotted lines.

Figure 4:
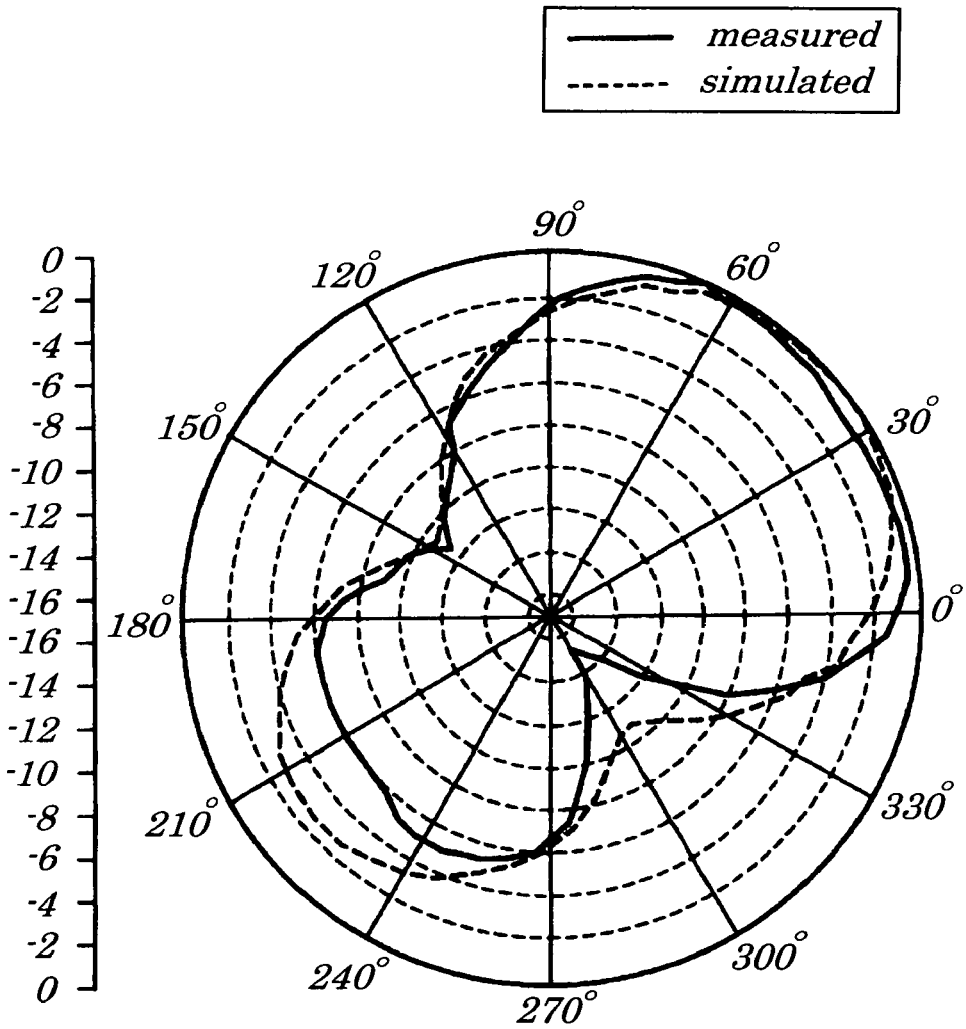
FIG. 4 is a diagram showing one example of a radiation characteristic of the antenna of the first embodiment of the present invention.
Figure 5:
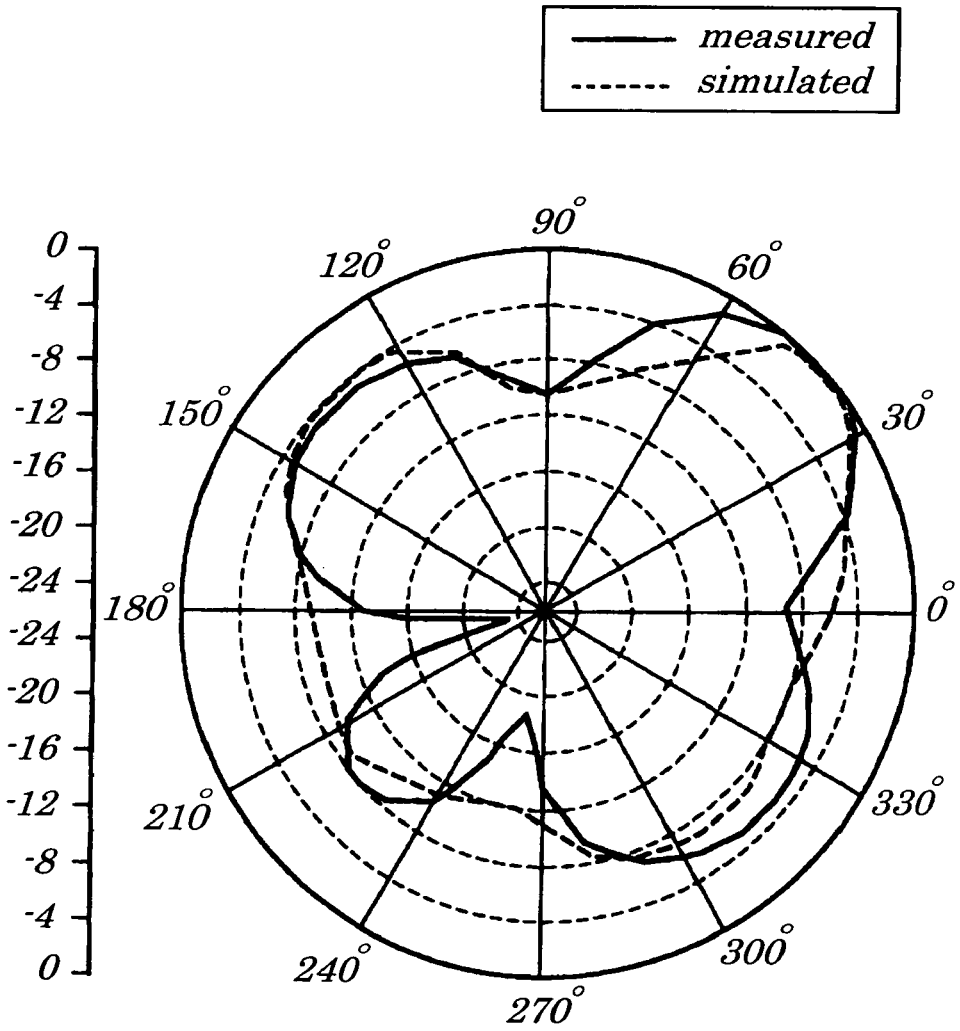
FIG. 5 is a diagram showing another example of a radiation characteristic of the antenna of the first embodiment of the present invention.

FIG. 4 shows a radiation characteristic on a level surface at resonance frequencies of about 2 GHz and FIG. 5 shows a radiation characteristic on a level surface at resonance frequencies of about 6 GHz. As shown in FIGS. 4 and 5, at both frequencies, antenna directivity that maximizes a gain is given in a direction at about 45 degrees (also, in the plan view of FIG. 1, the directivity is given in a direction at 45 degrees). Change in the direction of the directivity can be achieved by controlling an ON/OFF state of each of the switches 2 so that a shape in which the cross-dipole antenna (serving as the radiator) 10 and reflector 20 rotate around a central point (signal feeding point 3) is formed. At this point, there is a case in which a position of the signal feeding point 3 has to be simultaneously changed among the antenna elements 1, which can be achieved by changing the signal feeding point 3 using the switches 2. In FIGS. 4 and 5, actually-measured data is shown by solid lines and simulated-data is shown by dotted lines.

Thus, with the configuration as described above, the antenna device is so constructed that its shape is freely changed and its directivity can be changed to deal with a signal in any frequency band. The antenna device is made up of two or more antenna elements and switches which put each of the antenna elements into a connected or disconnected state. By controlling the switches, a shape of the antenna is changed so as to have a 90-degree bent dipole configuration to provide directivity, and a length of the antenna is changed so as to allow a changeover of a frequency band. The antenna device has a reflector being similar to the dipole-type antenna, which enables improvements in its directivity.

Second Embodiment

Figure 6:
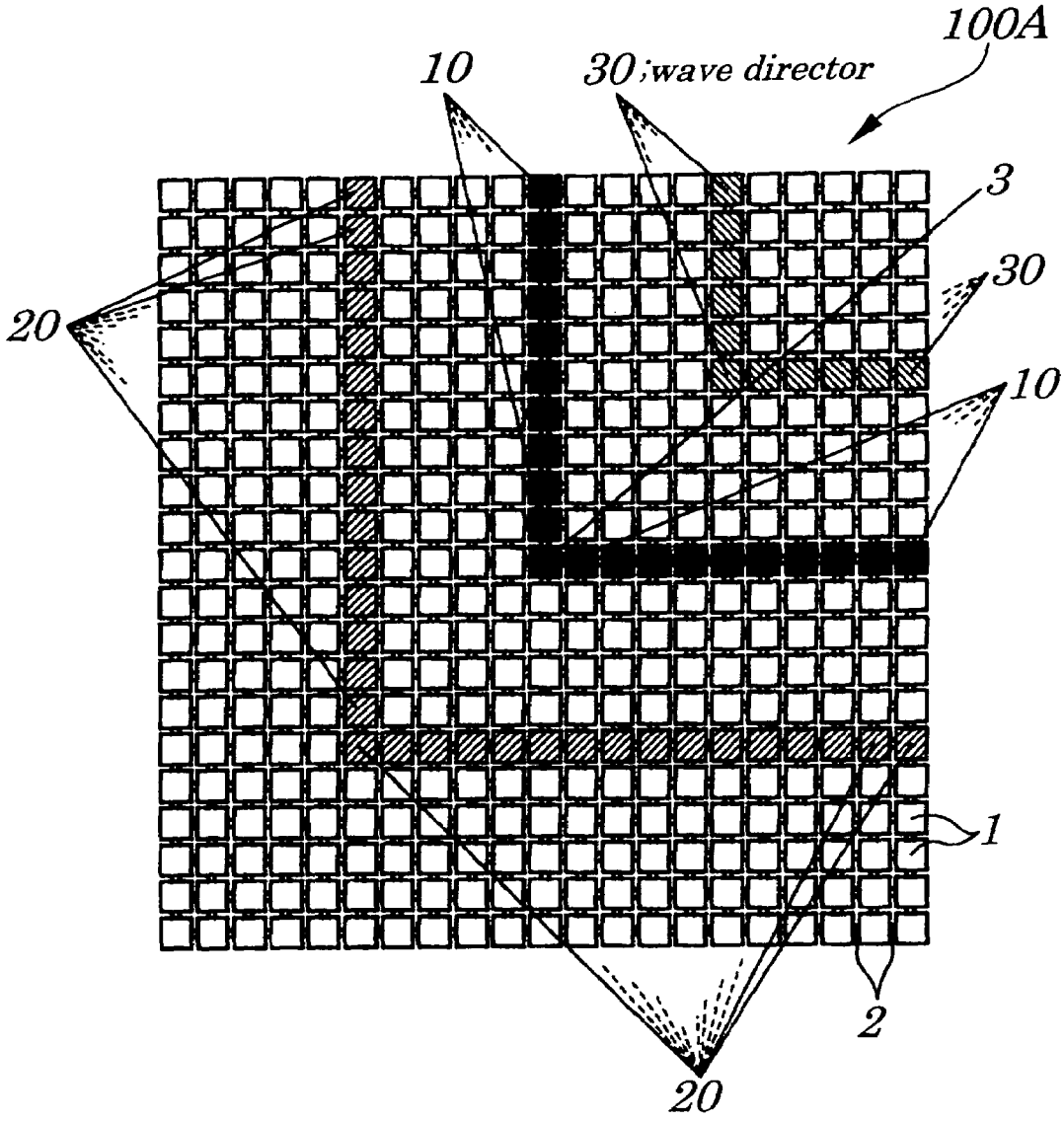
FIG. 6 is a plan view showing configurations of an antenna according to a second embodiment of the present invention.

FIG. 6 is a plan view showing configurations of an antenna structure 100A according to a second embodiment of the present invention and, in FIG. 6, same reference numbers are assigned to components having the same function as in FIG. 1. In the second embodiment, in addition to the components employed in FIG. 1, a wave director 30 is newly mounted. That is, a group of antenna elements 1 connected by the switch 2 to one another is arranged on a side opposite to the reflector 20 relative to the cross-dipole antenna (serving as the radiator) 10 in a manner in which the group of the antenna elements making up the wave director 30 is shorter than the group of the antenna elements making up the cross-dipole antenna (serving as the radiator) 10. The group of the antenna elements 1 serving as the wave director 30 is located at a specified distance apart from the group of the antenna elements 1 making up the cross-dipole antenna (serving as the radiator) 10 in a manner in which the switches 2 connected among the antenna elements 1 are turned ON to electrically connect the antenna elements 1 making up the group to one another and in which the group of the antenna elements 1 has a 90-degree bent shape being similar to the cross-dipole antenna (serving as the radiator) 10.

For the switches 2, a high-frequency transistor can be used. In addition, for the switches 2, a pin diode or an MEMS switch can be used instead of the high-frequency transistor. In particular, the MEMS switch which acts as a mechanical switch can be employed as a low-loss switch even in a high frequency range. Moreover, by adding a variable reactance component such as variable capacitance, variable inductance, or the like, it is made possible to change an electric length and/or a coupling amount among the antenna elements 1 and to form complicated directivity patterns.

The antenna elements 1 and the switches 2 making up the antenna structure 100, 100A according to the above embodiments can be manufactured by ordinary integrated-circuit technology or MEMS-circuit manufacturing technology. As a material for a circuit substrate of the antenna structure 100, 100A, a semiconductor material such as silicon or the like or dielectric material such as glass or the like can be used. In a structure of the antenna structure 100, 100A of the second embodiment, in order to enhance a radiation characteristic, a non-conductive substrate can be preferably used rather than a conductive substrate such as aluminum or the like. Moreover, by using a high-dielectric material, a wavelength shortening effect can be obtained, which makes it possible to reduce a size of the antenna structure 100, 100A according to the above embodiments.

Figure 7:
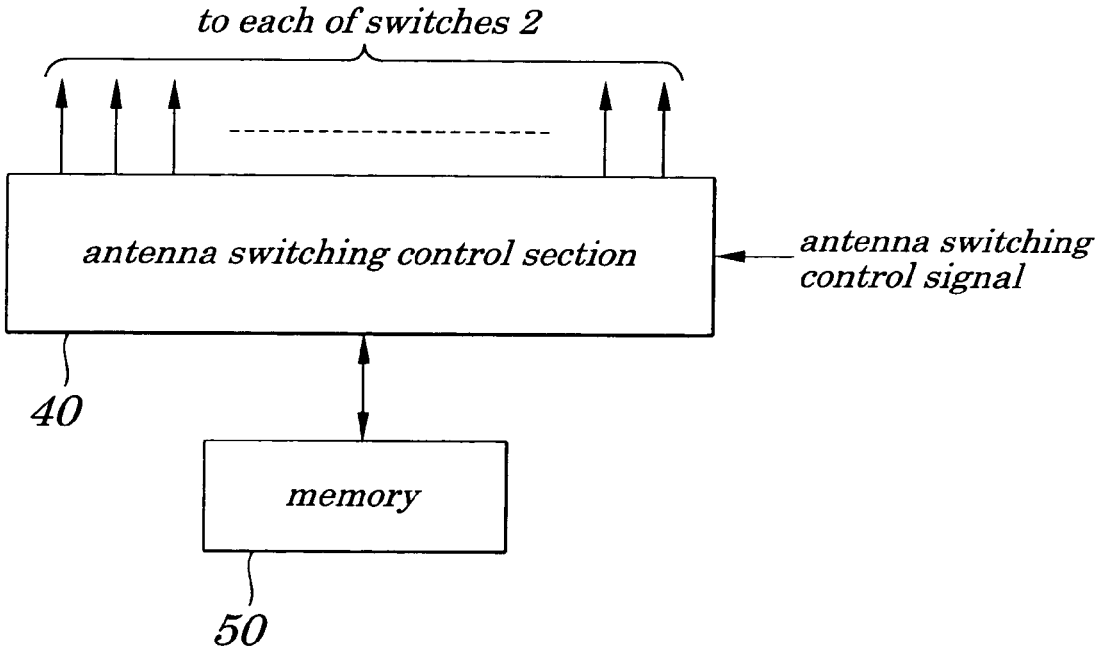
FIG. 7 is a schematic block diagram explaining functions of a switching control circuit for each of switches employed in the second embodiment of the present invention.

By additionally mounting a memory (memory circuit) used to store an ON/OFF state of each of the switches 2 in advance, setting of frequencies to be used and required directivity can be switched. FIG. 7 is a schematic block diagram explaining functions of a switching control circuit for each of switches employed in the second embodiment of the present invention. The switching control circuit is made up of a memory 50 such as a ROM (Read Only Memory) which stores two or more pairs of switch ON/OFF states and an antenna switching control section 40 which reads contents of the memory 50 by an antenna switching control signal to use them as an ON/OFF control signal for each of the switches 2. The switching control circuit shown in FIG. 7 can be fabricated on the same substrate as that of the antenna structure 100, 100A by using semiconductor integration technology. Since the number of control signals including those for the switches 2 becomes large, it is preferable that the switching control circuit shown in FIG. 7 is mounted on the same substrate as that of the antenna structure 100, 100A.

It is apparent that the present invention is not limited to the above embodiments but may be changed and modified without departing from the scope and spirit of the invention. For example, a shape, size, quantity, and arrangement of each of the antenna elements of the embodiments can be changed variously depending on conditions of use of required frequencies or the like and the present invention is not limited to examples shown in the above embodiments.

Moreover, the antenna of the present invention can be used as an antenna for wireless communication devices such as a portable cellular phone, WLAN (Wireless Local Area Network), or the like and can be employed as an antenna for a wireless terminal, GPS (Global Positioning System), RFID (Radio Frequency Identification, that is, Radio Tag), in particular.

What is claimed is:

1. An antenna device comprising:

a single matrix of two or more quadrangular antenna elements; and switches to control so as to put said antenna elements being adjacent to each other into an electrically connected or disconnected state, wherein a cross-dipole antenna having a 90-degree bent shape is formed by a group of said antenna elements being electrically connected to one another by said switches, and a signal feeding point, to which a signal line for inputting and outputting of signals is connected, is so configured to be changed in position on said single matrix by switching, as required.

2. The antenna device according to claim 1, wherein each of said switches has a variable reactance component.

3. The antenna device according to claim 1, wherein a signal line for inputting and outputting of signals is connected to at least one antenna element selected from a group of said antenna elements being electrically connected to one another by said switches, said at least one antenna element positioned in a center portion of said single matrix and serving as the signal feeding point.

4. The antenna device according to claim 3, further comprising one or two other group of said antenna elements each being connected to one another by said switches so as to have a 90-degree bent shape and being located at a specified distance apart from said group of said antenna elements, wherein said group of said antenna elements to be connected to said signal line from which power is fed act as a radiation element, whereas said one or two other group of antenna elements acts as a reflector and/or as a wave director.

5. The antenna device according to claim 1, wherein each of said switches comprises a high-frequency transistor, pin diode, or MEMS (Micro Electro Mechanical System) switch.

6. The antenna device according to claim 1, further comprising a storing unit to store, in advance, two or more sets of combinations of electrically connected or disconnected states of said switches and a controlling unit to read a specified set of said combinations from said storing unit according to a control signal so that said switches are controlled.

7. The antenna device according to claim 1, wherein said two or more antenna elements each has a square shape.

8. A wireless communication device being equipped with an antenna device comprising a single matrix of two or more quadrangular antenna elements, and switches to control so as to put said antenna elements being adjacent to each other into an electrically connected or disconnected state, wherein a cross-dipole antenna having a 90-degree bent shape is formed by a group of said antenna elements being electrically connected to one another by said switches, and a signal feeding point, to which a signal line for inputting and outputting of signals is connected, is so configured to be changed in position on said single matrix by switching, as required.

9. A wireless communication device according to claim 8, wherein a signal line for inputting and outputting of signals is connected to at least one antenna element selected from a group of said antenna elements being electrically connected to one another by said switches, said at least one antenna element positioned in a center portion of said single matrix and serving as the signal feeding point, wherein said antenna device further has one or two other groups of said antenna elements each being connected to one another by said switches so as to have a 90-degree bent shape and being located at a specified distance apart from said group of said antenna elements, and wherein said group of said antenna elements to be connected to said signal line from which power is fed act as a radiation element, whereas said one or two other groups of antenna elements acts as a reflector and/or as a wave director.

* * * * *